US009179805B1

(12) United States Patent
Spratt-Anderson

(10) Patent No.: US 9,179,805 B1
(45) Date of Patent: Nov. 10, 2015

(54) DETACHABLE WALL MOUNTED SHOWER SEAT FOR SEATING A YOUNG CHILD TO SHOWER WITH AN ADULT

(71) Applicant: Melanie Spratt-Anderson, McCamey, TX (US)

(72) Inventor: Melanie Spratt-Anderson, McCamey, TX (US)

( * ) Notice: Subject to any disclaimer, the term of this patent is extended or adjusted under 35 U.S.C. 154(b) by 301 days.

(21) Appl. No.: 13/868,446

(22) Filed: Apr. 23, 2013

Related U.S. Application Data

(60) Provisional application No. 61/638,335, filed on Apr. 25, 2012.

(51) Int. Cl.
*A47K 3/00* (2006.01)
*A47K 3/28* (2006.01)

(52) U.S. Cl.
CPC ..... *A47K 3/282* (2013.01)

(58) Field of Classification Search
CPC ..... A47K 3/282; A47K 3/127; A47K 3/122; A47K 2201/02; A47C 4/30; A47D 15/006; A47D 1/02; A47D 1/006; A47D 1/10; A47D 1/106; A61G 7/1003; A61G 7/1005; A61G 7/1059; E04H 4/14; E04H 4/144
USPC ..... 4/496, 504, 561.1–563.1, 564.1–566.1, 4/572.1, 604, 611; 297/13, 14, 217.7, 297/230, 254, 256.12, 256.16, 308, 344.15, 297/344.21, 344.24, 344.25, 354.11, 297/354.21; 244/122 R; 248/220.22, 224.7, 248/225.11, 291.1, 297.21
See application file for complete search history.

(56) References Cited

U.S. PATENT DOCUMENTS

| | | | | | |
|---|---|---|---|---|---|
| 326,184 | A | * | 9/1885 | White | 297/338 |
| 1,252,751 | A | * | 1/1918 | Weatherford | 297/466 |
| 2,647,561 | A | * | 8/1953 | Szabo | 297/313 |
| 3,142,513 | A | * | 7/1964 | Skokut | 297/344.22 |
| 5,185,892 | A | * | 2/1993 | Mitchell | 4/578.1 |
| 5,335,970 | A | * | 8/1994 | Bryant et al. | 297/344.22 |
| 5,362,123 | A | * | 11/1994 | Simmons | 297/14 |
| 5,465,437 | A | * | 11/1995 | Herman | 4/611 |
| 5,722,100 | A | * | 3/1998 | Jozwiak | 4/572.1 |
| 2004/0021353 | A1 | * | 2/2004 | Lozano et al. | 297/255 |

* cited by examiner

*Primary Examiner* — Paul R Durand
*Assistant Examiner* — Nicholas Ros

(57) ABSTRACT

A detachable wall mounted shower seat enables a user to seat a young child to shower with the user while allowing a seat to rotate in order to provide the young child with greater access to different direction of water. The detachable wall mounted shower seat includes the seat with a seat frame where the seat frame is attached to a seat fabric. The user can place the young child on the seat fabric. The seat frame is attached to an upper seat bracket and a lower seat bracket which are attached to bracket plate can be attached to the wall in a manner that enables the seat to slightly recline, which is naturally relaxing to the young child.

5 Claims, 4 Drawing Sheets

DETACHABLE WALL MOUNTED SHOWER SEAT FOR SEATING A YOUNG CHILD TO SHOWER WITH AN ADULT

RELATED APPLICATION

This application claims priority to provisional patent application U.S. Ser. No. 61/638,335 filed on Apr. 25, 2012, the entire contents of which is herein incorporated by reference.

BACKGROUND

The embodiments herein relate generally to a detachable wall mounted shower seat. Prior to the disclosed invention, it was needlessly challenging to bathe a young child. The child would need to be bathed separately of an adult or in a bathtub. The prior art comprises U.S. Pat. No. 5,362,123 issued to Simmons, U.S. Pat. No. 5,310,242 issued to Golder, and U.S. Pat. No. 6,807,690 issued to Satterfield.

Simmons teaches a seat that is mounted to a wall where the seat can accommodate the child by using a sewn material for a base that rests between arms like a hammock. This serves to trap the child in place because the young child lacks the strength to lift one's legs from the hammock. However, this cannot be used to bathe a child because whatever runs from the child with water will pool in the hammock, making parts of the child cleaner than others.

Golder teaches a wall mounted child's seat that secures a child to a cushion with a plurality of straps. Golder, like Simmons is designed for the static application of keeping a young child in place in a public restroom. Embodiments of the present invention assist a user in bathing a child in a shower. Typically, shower heads are static, so a user must rotate proximate the shower head in order to wash. Golder and Simmons offer no theory of how to rotate the wall mounted child's seat in order to clean the child.

Satterfield notes that the ability for a wall mounted seat to pivot can be useful. However, it uses the pivot in a manner similar to Golder and Simmons, that is, to make the wall mounted seat compact. Embodiments of the present invention are concerned with rotation at tangent to the wall, not rotation orthogonal to the wall, as noted above this allows the user to bath the child as opposed to keeping the child in place.

SUMMARY

A detachable wall mounted shower seat enables a user to seat a young child in a shower with the user allowing a seat to rotate in order to provide the young child with greater access to different direction of water. The detachable wall mounted shower seat comprising, the seat comprising a seat frame where the seat frame is mechanically coupled to a seat fabric. The user can place the young child on the seat fabric. The seat frame is further mechanically coupled to an upper seat bracket and a lower seat bracket. The upper seat bracket and the lower seat bracket are further mechanically coupled to a bracket plate that can accommodate a wall plate cylinder such that a plane which parallel to the bracket plate is tangent to a wall. This enables the seat to slightly recline naturally relaxing the young child. The wall plate cylinder is mechanically coupled to a wall plate swivel arm which is mechanically coupled to the wall. This enables the user to rotate the seat providing the young child with the greater access to different direction of the water in the shower.

The seat fabric is mechanically coupled to a first leg strap and a second leg strap to secure legs of the young child in the seat. The seat frame is further mechanically coupled to a male torso buckle strap which is mechanically coupled to a male buckle. The seat frame is further mechanically coupled to a female torso buckle strap which is mechanically coupled to a female buckle. The user can place the young child onto the seat fabric and then hold the young child in place by inserting the male buckle into the female buckle with the male torso buckle strap and the female torso buckle strap across a torso of the young child. This secures the young child safely to the seat.

The seat frame comprises a back u-shaped bar with a back first end connected to a first joint and a back second end connected to a second joint mechanically coupled to a seat u-shaped bar with a seat first end connected to the first joint and a seat second end connected to the second joint. This enables the user to fold the back u-shaped bar proximate the seat u-shaped bar making the seat frame portable. Further, the water can drain from the side of the first joint and the second joint when no seat material is present at the first joint and the second joint aiding the user in cleaning the detachable wall mounted shower seat.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
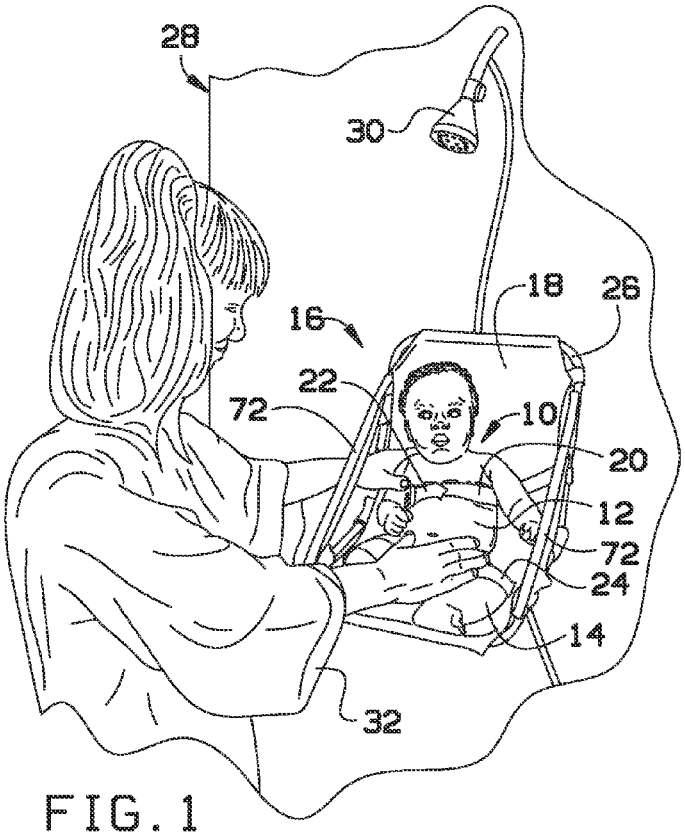
FIG. 1 is a perspective view of an embodiment of the invention shown in use.

FIG. 1 shows an embodiment of the detachable wall mounted shower seat in use. User 32 desires to bathe young child 10 with shower head 30 mechanically coupled to wall 28 in a known manner. Child 10 comprises torso 12 affixed to one or more legs 14. User 32 can accomplish this by placing child 10 in seat 16. Seat 16 comprises seat frame 26 mechanically coupled to seat fabric 18 as shown in more detail in FIG. 2 and FIG. 3. Seat frame 26 is further mechanically coupled to leg strap 24 which can hold legs 14 of child 10 in place. Seat frame 26 is further mechanically coupled to male torso buckle strap 20 and female torso buckle strap 22 which can be used to secure young child 10 to seat 16 as shown in more detail in FIG. 2 and FIG. 3.

Figure 2:
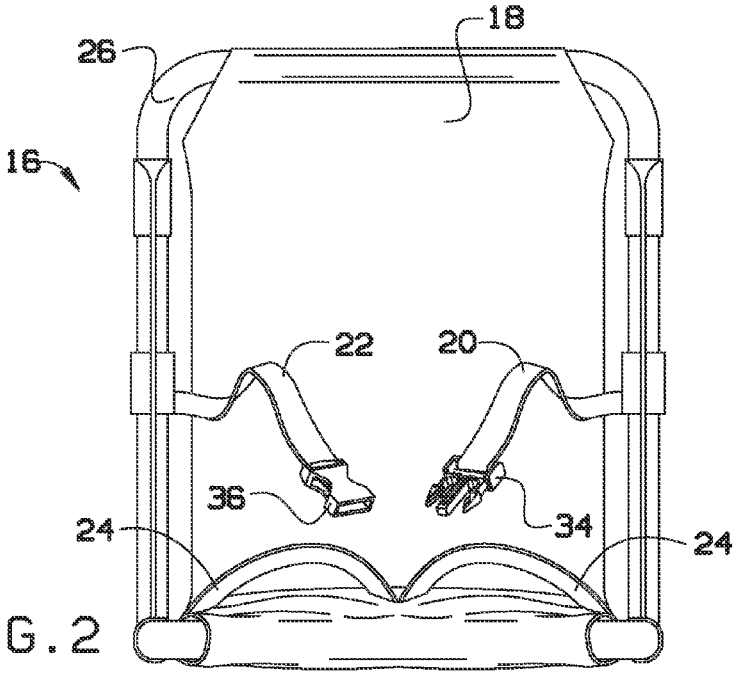
FIG. 2 is a front view of an embodiment of the invention.
Figure 3:
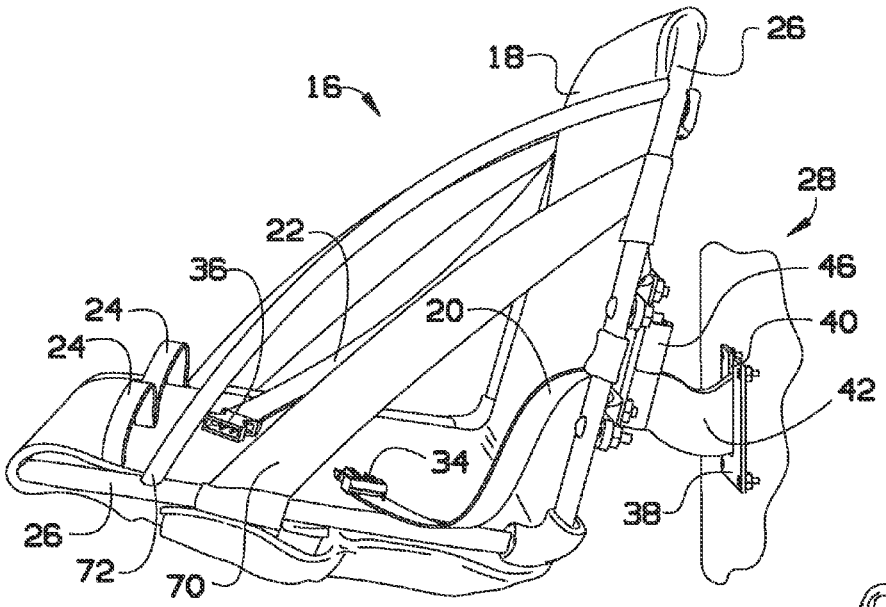
FIG. 3 is a side view of an embodiment of the invention.
Figure 4:
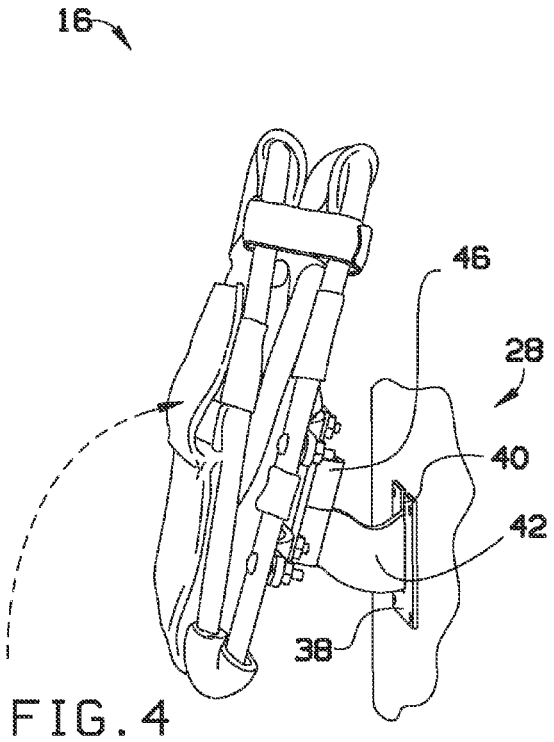
FIG. 4 is a side view of an embodiment of the invention illustrated in collapsed configuration.
Figure 11:
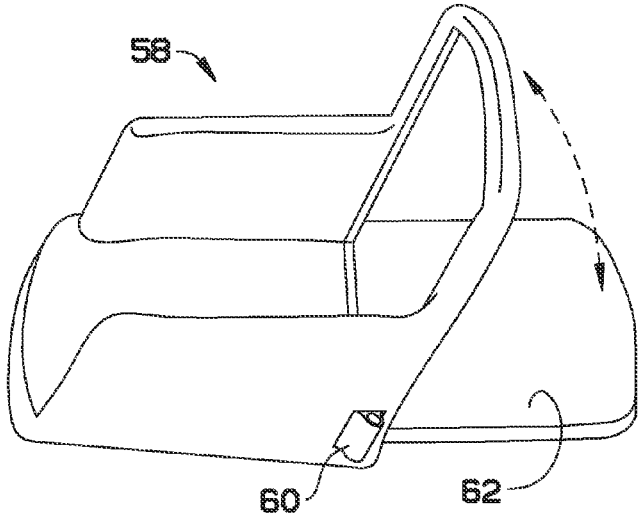
FIG. 11 is a perspective view of an embodiment of an alternate embodiment of the invention.

FIG. 2 and FIG. 3 show additional views of seat 16. Seat frame 26 can be made from a back u-shaped bar with a back first end connected to a first joint and a back second end connected to a second joint mechanically coupled to a seat u-shaped bar with a seat first end connected to the first joint and a seat second end connected to the second joint. This construction enables user 32 to fold the back u-shaped bar proximate the seat u-shaped bar as shown in FIG. 4. However, the motion of the back u-shaped bar distant the seat u-shaped bar as shown in FIG. 3 is limited by first forward seat fabric 70 and second forward seat fabric 72 which are affixed to the back u-shaped bar and the seat u-shaped bar limiting an angle of the first joint and the second joint between the back u-shaped bar and the seat u-shaped bar. An alternate configuration without this feature is shown in FIG. 11.

Seat fabric 18 is attached to the back u-shaped bar and the seat u-shaped bar in several places. Seat fabric 18 should be made of a hydrophobic material that can wick away water. Seat fabric 18 is mechanically coupled to first leg strap 24 and second leg strap 24 to accommodate legs 14 of young child 10 as noted above.

Male torso buckle strap 20 is mechanically coupled to male buckle 34. Female torso buckle strap 22 is mechanically coupled to female buckle 36. A user can place young child 10 onto seat fabric 18 and then hold young child 10 in place by inserting male buckle 34 into female buckle 36 with male torso buckle strap 20 and female torso buckle strap 22 across torso 12.

Figure 6:
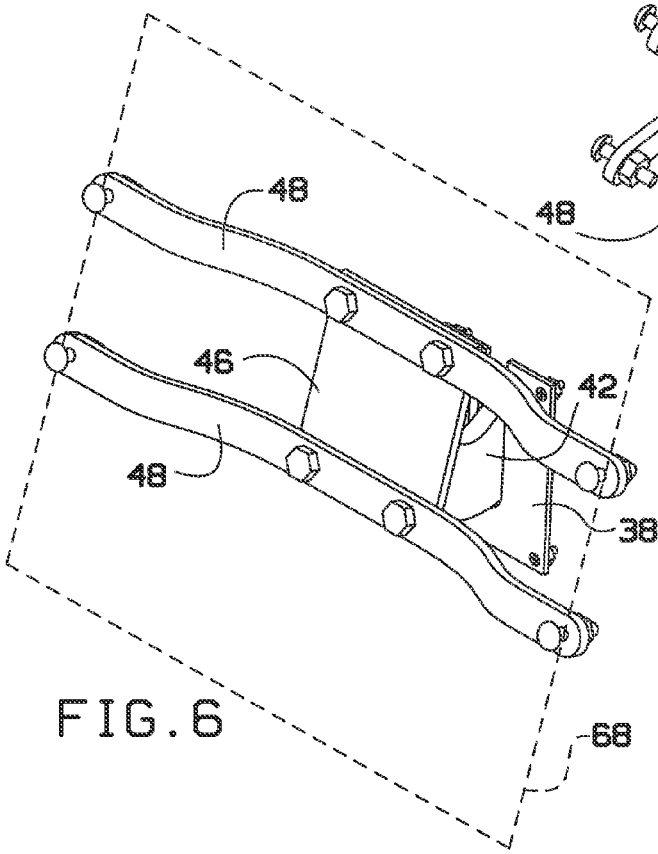
FIG. 6 is a forward perspective view of an embodiment of the support bracket components.
Figure 7:
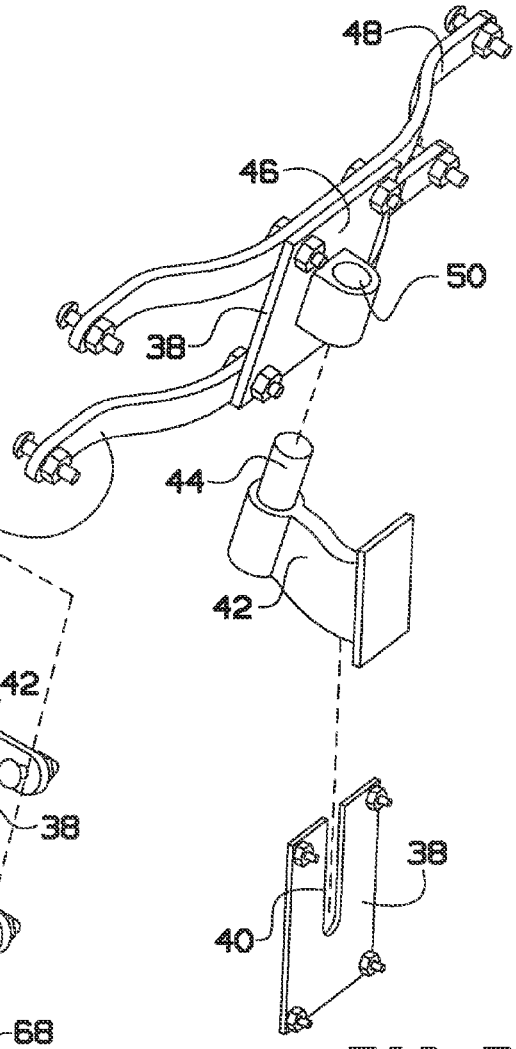
FIG. 7 is an exploded view of an embodiment of the primary support bracket components.
Figure 8:
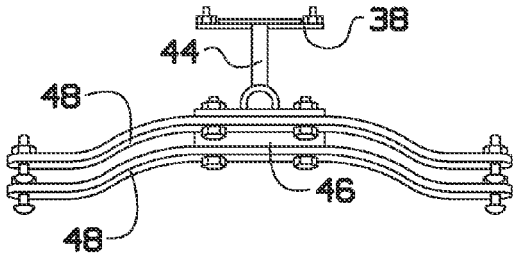
FIG. 8 is a top view of an embodiment of the support bracket components.

FIG. 3 demonstrates how seat frame 26 is mechanically coupled to seat bracket 48 which is shown in more detail in FIG. 6 and FIG. 7. Upper seat bracket 48 is mechanically coupled to seat frame 26 with bolts. Likewise, lower seat bracket 48 is mechanically coupled to seat frame 26 with bolts. Both upper seat bracket 48 and lower seat bracket 48 are mechanically coupled to seat bracket plate 46 with bolts. Seat bracket plate 46 is mechanically coupled to seat bracket mount 50 which comprises a cylindrical cavity which can accommodate wall plate cylinder 44.

Figure 5:
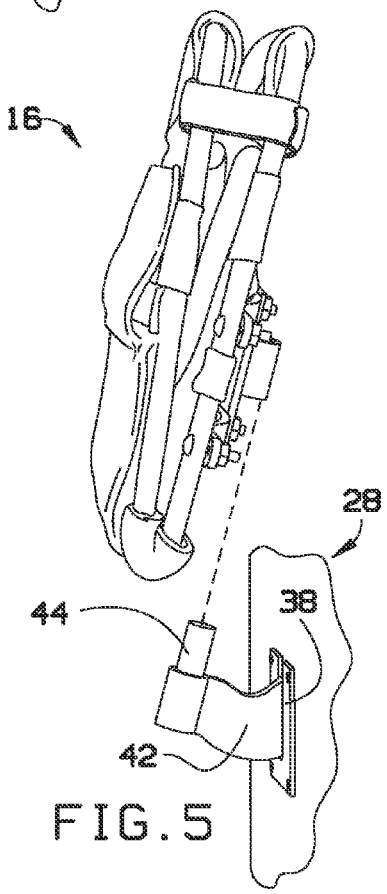
FIG. 5 is an exploded view of an embodiment of the invention illustrated separated from wall bracket.

Wall plate cylinder 44 is mechanically coupled to wall plate swivel arm 42. Wall plate swivel arm 42 can fit inside wall plate slot 40 in wall plate 38. Wall plate 38 is mechanically coupled to wall 28 as shown in FIG. 3, FIG. 4 and FIG. 5.

Figure 9:
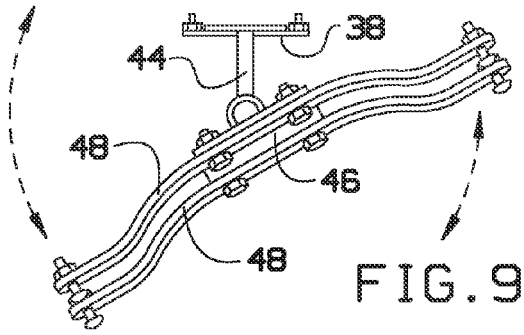
FIG. 9 is a top view of an embodiment of the support bracket components illustrating exemplary range of rotational motion.
Figure 10:
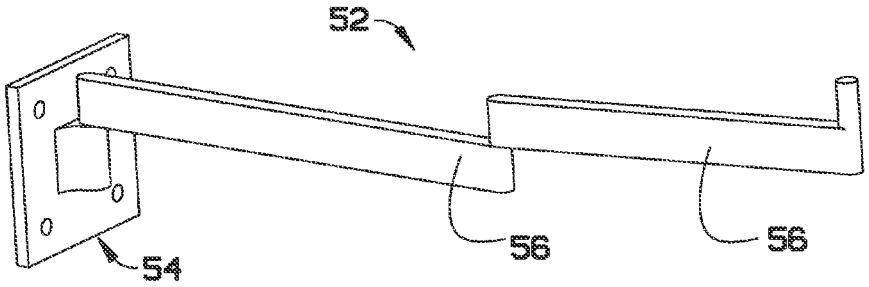
FIG. 10 is a perspective view of an embodiment of an alternate embodiment of the invention.

As shown in FIG. 6, FIG. 7, FIG. 8 and FIG. 9, wall plate cylinder 44 is angled toward wall 28 such that bracket plate 26 is similarly arranged resulting in lower seat bracket 48 being slightly distant from wall 28 compared to upper seat bracket 48. This causes the back u-shaped bar to be angled slightly backward which can assist small child 10 in relaxing in seat 16. The prior art handles this in a contrary manner with Golder, Simmons and Satterfield reclining their respective seats from a plane which is parallel to the wall. Here, plane 68 parallel to seat bracket plate 46 is tangent to wall 28. Additionally, as shown in FIG. 9, a user can rotate bracket plate 46, and thus the back u-shaped bar on a plane tangent to wall 28 which enables user 32 to wash young child 10 and provide young child 10 with greater access to different direction of water Other features can be incorporated based on user preference. For instance, in FIG. 10, extension arm 52 comprises extendable bracket plate 54 mechanically coupled to first extendable bracket arm 56. First extendable bracket arm 56 is mechanically coupled to second extendable bracket arm 56. Second extendable bracket arm 56 can be detachably coupled to seat bracket mount 50 in a manner similar to that above. This provides greater maneuverability of seat 16.

FIG. 11, shows collapsible seat 58 which comprises collapsing seat back 62 that can be accomplished by removing first forward seat fabric 70 and second forward seat fabric 72. This would enable seat back 62 to collapse. In this configuration seat bracket 60 should be located on the side of collapsible seat 58.

Figure 12:
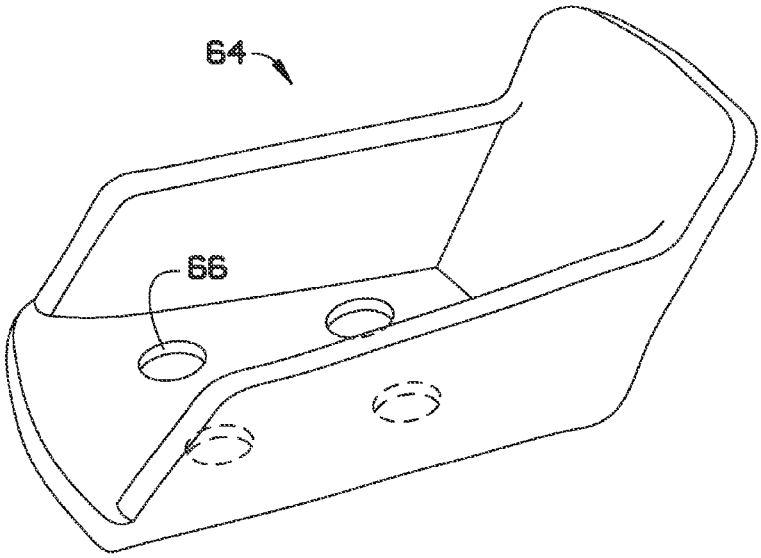
FIG. 12 is a perspective view of an embodiment of an alternate embodiment of the invention.

FIG. 12 shows another possible use of embodiments of the invnetion that can be used for washing a small dog. As noted above, one difficulty with the prior art was the lack of ability to drawing water. Seat 16 above solves that problem by channeling water toward the first joint and the second joint and then out of seat 16. Molded seat 64 solves the problem in a slightly different manner with utilizing cavities 66, both to accommodate legs of the small dog and also to allow water to drain from molded seat 64.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A detachable wall mounted shower seat for seating a young child to shower with a user allowing a seat to rotate in order to provide the young child with greater access to different direction of water, the detachable wall mounted shower seat comprising, the seat comprising a seat frame; wherein the seat frame farther comprises a back u-shaped bar with a back first end connected to a first joint and a back second end connected to a second joint mechanically coupled to a seat u-shaped bar with a seat first end connected to the first joint and a seat second end connected to the second joint;

where the seat frame is mechanically coupled to a seat fabric; where the user can place the young child on the seat fabric; the seat frame is further mechanically coupled to an upper seat bracket and a lower seat bracket; where the upper seat bracket and the lower seat bracket are further mechanically coupled to a bracket plate that can accommodate a wall plate cylinder such that a plane which parallel to the bracket plate is tangent to a wall; this enables the seat to slightly recline naturally relaxing the young child; the wall plate cylinder is mechanically coupled to a wall plate swivel arm which is mechanically coupled to the wall; this enables the user to rotate the seat providing the young child with the greater access to different direction of the water in the shower.

2. The detachable wall mounted shower seat of claim 1, wherein the seat fabric is mechanically coupled to a first leg strap and a second leg strap to secure legs of the young child in the seat; the seat frame is further mechanically coupled to a male torso buckle strap which is mechanically coupled to a male buckle; the seat frame is further mechanically coupled to a female torso buckle strap which is mechanically coupled to a female buckle; the user can place the young child onto the seat fabric and then hold the young child in place by inserting the male buckle into the female buckle with the male torso buckle strap and the female torso buckle strap across a torso of the young child; this secures the young child safely to the seat.

3. The detachable wall mounted shower seat of claim 1, wherein the water can drain from the side of the first joint and the second joint when no seat material is present at the first joint and the second joint aiding the user in cleaning the detachable wall mounted shower seat.

4. The detachable wall mounted shower seat of claim 1, wherein motion of the back u-shaped bar that is distant the seat u-shaped bar is limited by a first forward seat fabric and a second forward seat fabric which are affixed to the back u-shaped bar and the seat u-shaped bar limiting an angle of the first joint and the second joint between the back u-shaped bar and the seat u-shaped bar; the water can drain from the side of the first joint and the second joint when no seat material is present at the first joint and the second joint aiding the user in cleaning the detachable wall mounted shower seat.

5. The detachable wall mounted shower seat of claim 1, wherein an extension arm comprises an extendable bracket plate mechanically coupled to first extendable bracket arm; the first extendable bracket arm is mechanically coupled to second extendable bracket arm; the second extendable bracket arm is detachably coupled to the bracket plate to provide greater maneuverability for the seat.

* * * * *